US008839490B2

(12) United States Patent
Vogler et al.

(10) Patent No.: US 8,839,490 B2
(45) Date of Patent: Sep. 23, 2014

(54) FOLDABLE HINGE ASSEMBLY

(75) Inventors: Michael R. Vogler, Oswego, IL (US); Michael Uffner, Naperville, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 13/554,404

(22) Filed: Jul. 20, 2012

(65) Prior Publication Data

US 2014/0020208 A1 Jan. 23, 2014

(51) Int. Cl.

| | |
|---|---|
| ***E05D 5/02*** | (2006.01) |
| ***E05D 5/14*** | (2006.01) |
| ***E05D 1/02*** | (2006.01) |
| *E05D 3/02* | (2006.01) |

(52) U.S. Cl.

CPC ... *E05D 1/02* (2013.01); *E05D 3/02* (2013.01); *E05D 5/14* (2013.01)

USPC ..... 16/252

(58) Field of Classification Search

CPC ..... E05D 1/02; E05D 3/02; E05D 5/14

USPC ..... 16/252, 225–227, 387, 223; 220/845, 220/847; 248/291.1, 316.5, 74.1; 52/69–71

See application file for complete search history.

(56) References Cited

U.S. PATENT DOCUMENTS

| | | | | | |
|---|---|---|---|---|---|
| 494,988 | A * | 4/1893 | Libbey | 16/226 |
| 2,763,890 | A * | 9/1956 | Cox | 16/253 |
| 4,141,107 | A * | 2/1979 | Sheiman et al. | 16/221 |
| 4,144,924 | A * | 3/1979 | Vanden Hoek | 160/231.2 |
| 4,354,611 | A * | 10/1982 | Propst et al. | 220/827 |
| 4,400,847 | A * | 8/1983 | Farber | 16/223 |
| 4,729,149 | A * | 3/1988 | Brunkan | 16/252 |
| 2005/0210631 | A1* | 9/2005 | Anscher | 16/386 |
| 2009/0205166 | A1* | 8/2009 | Murray | 16/221 |
| 2013/0000080 | A1* | 1/2013 | Bailey | 16/380 |

* cited by examiner

*Primary Examiner* — Victor Batson
*Assistant Examiner* — Matthew Sullivan
(74) *Attorney, Agent, or Firm* — McHale & Slavin, P.A.

(57) ABSTRACT

Briefly, the invention involves a hinge construction. The hinge construction includes a pair of contoured wing members connected at one end with a living hinge, each wing member including a portion of a hinge barrel. The wings are constructed to be folded around a hinge pin, forming the hinge barrel and positioning the wings in a generally parallel relationship with respect to each other. A portion of a wall or door jamb is positioned between the wings. Fasteners or the like are secured through the wings to fix the assembly, whereby the hinge pin is free to rotate within the barrel created by the folded wings.

12 Claims, 5 Drawing Sheets

FOLDABLE HINGE ASSEMBLY

FIELD OF INVENTION

The present invention generally relates to hinges for connection of two solid objects for movement about a fixed axis with respect to each other, and more particularly to a foldable hinge assembly having an integral living hinge for assembly to the door in a flat configuration.

BACKGROUND INFORMATION

While it is unclear as to when hinges were invented, numerous types of hinges are currently known in the art. In ancient times hinges were used to make massive objects, such as protective gates, moveable. These hinges were typically not available to the average homeowner, but they still provided them with the benefit of protection if their home was positioned behind the heavy hinged gate.

Through the centuries, hinges have been constructed from various types of metals including brass, bronze, iron and steel. They have also been constructed in various specialized configurations.

Currently, hinges provide us with security for our homes, convenience within our homes, and strength to move objects we normally could not move. Hinges are included in our doors, windows, cabinets, appliances and the like, which add convenience to our everyday lives.

While hinges have become ubiquitous in our everyday lives, there remains a need for new hinges that offer new applications and ease of use features in order to achieve acceptance by the end user. These hinges should be easily and quickly assembled using minimal hardware and requiring a minimal number of tools. Further, the hinges should not require excessive strength to assemble or include numerous component parts requiring assembly. Moreover, the hinge must assemble together in such a way so as not to detract from the aesthetic appearance of the assembled hinge.

Thus, the present invention provides a foldable hinge assembly which overcomes the disadvantages of prior art hinges. The foldable hinge assembly of the present invention not only provides for relative ease of assembly and few component parts, it also permits assembly without the need to remove a door from its frame.

SUMMARY OF THE INVENTION

Briefly, the invention involves a hinge construction. The hinge construction includes a pair of contoured wing members connected at one end with a living hinge, each wing member including a portion of a hinge barrel. The wings are constructed to be folded around a hinge pin so that the hinge barrel is formed while positioning the wings in a generally parallel relationship with respect to each other. A portion of a wall or door jamb can then be positioned between or adjacent to the wings. Fasteners can then be secured through the wings to fix the assembly, whereby the hinge pin is free to rotate within the barrel created by the folded wings.

Accordingly, it is an objective of the present invention to provide a foldable hinge assembly.

It is a further objective of the present invention to provide a foldable hinge assembly which forms a hinge barrel upon folding.

It is yet a further objective of the present invention to provide a foldable hinge assembly having a living hinge connecting the wing members of the hinge.

It is another objective of the present invention to provide a foldable hinge assembly including alignment bosses for aligning the wing members.

It is another objective of the present invention to provide a foldable hinge assembly that includes a plurality of internal radially extending ribs.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

Figure 1:
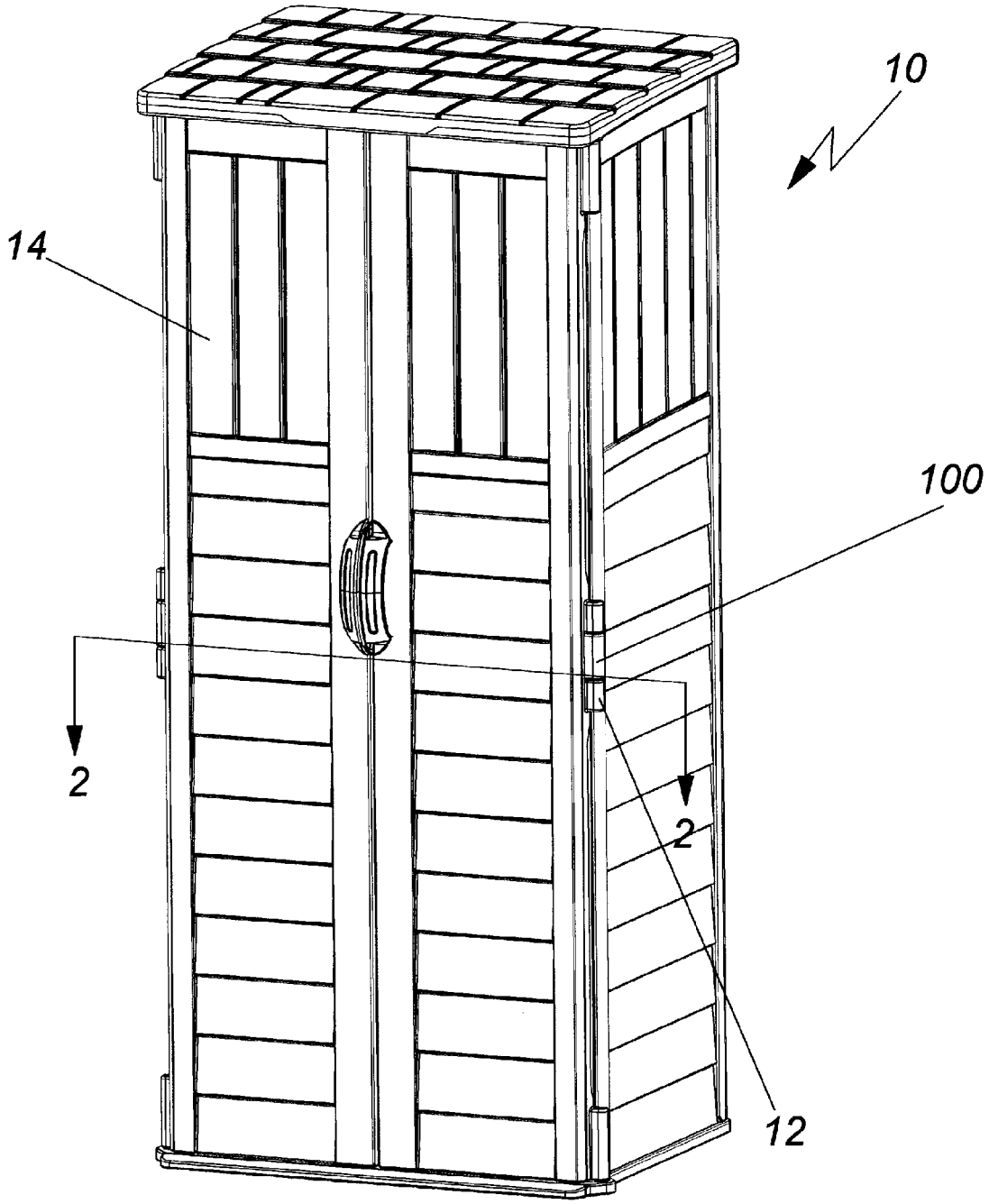
FIG. 1 is a top right perspective view of one embodiment of the present invention installed on a shed.
Figure 2:
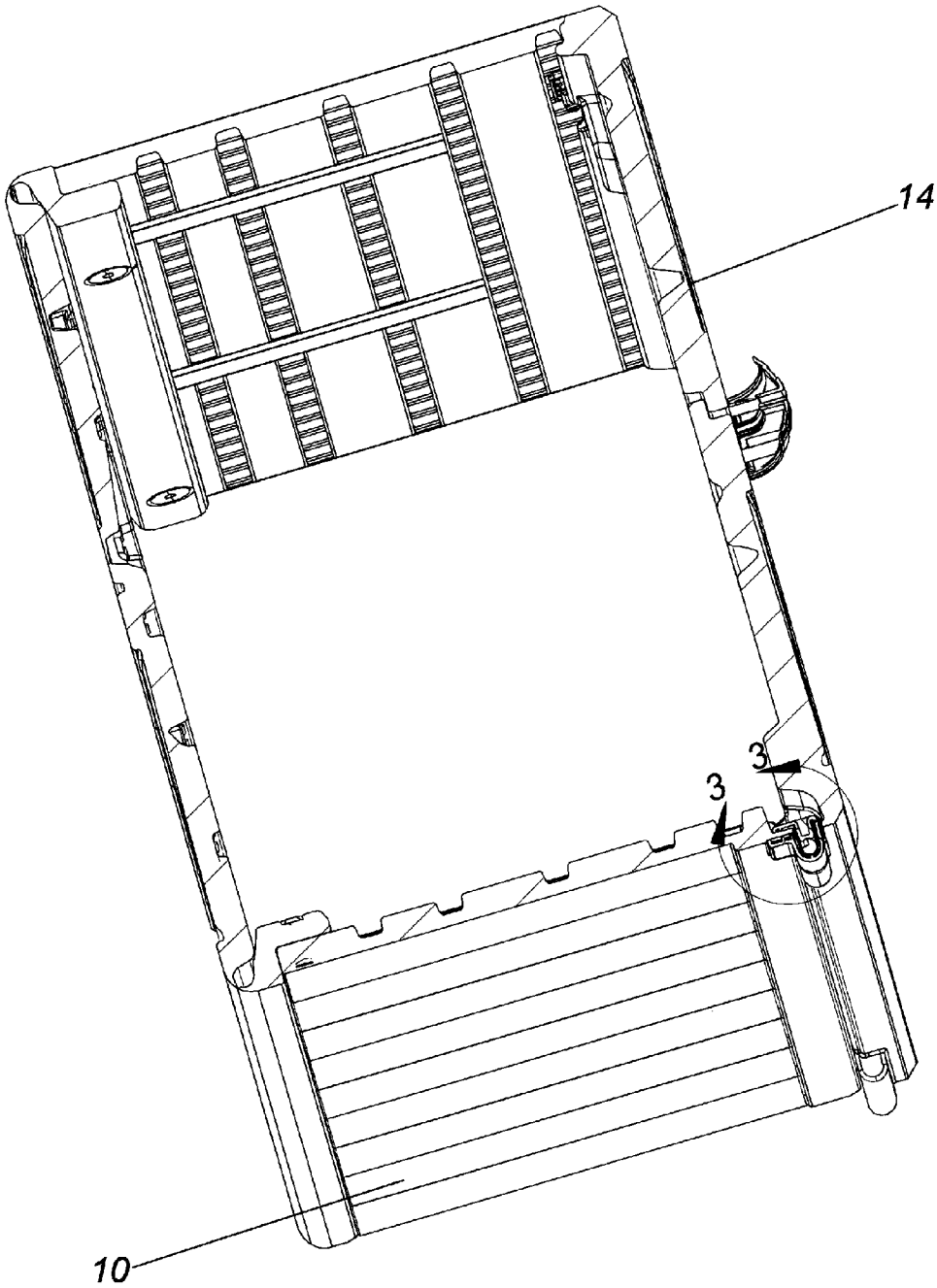
FIG. 2 is a section view taken along lines 2-2 of FIG. 1, illustrating a folding hinge assembly installed about a hinge pin.
Figure 3:
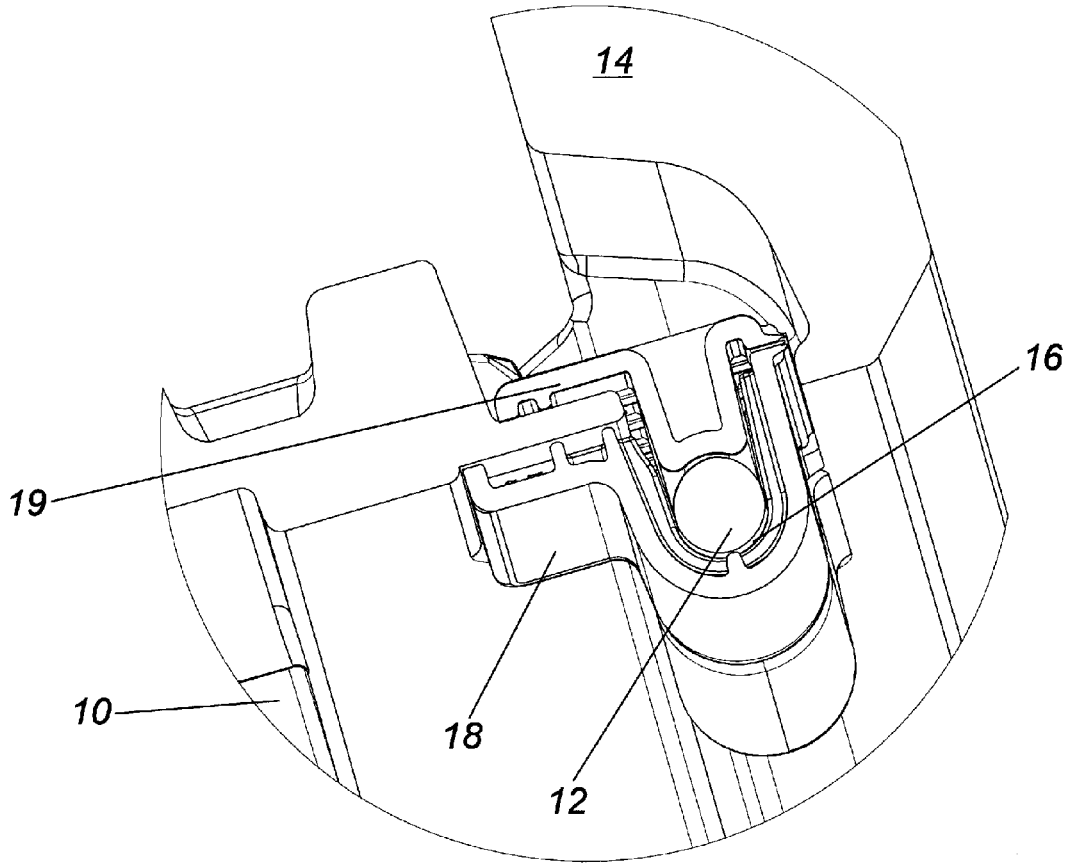
FIG. 3 is a partial top perspective view of the embodiment shown in FIG. 2 illustrating the folding hinge assembly installed about a hinge pin.
Figure 4:
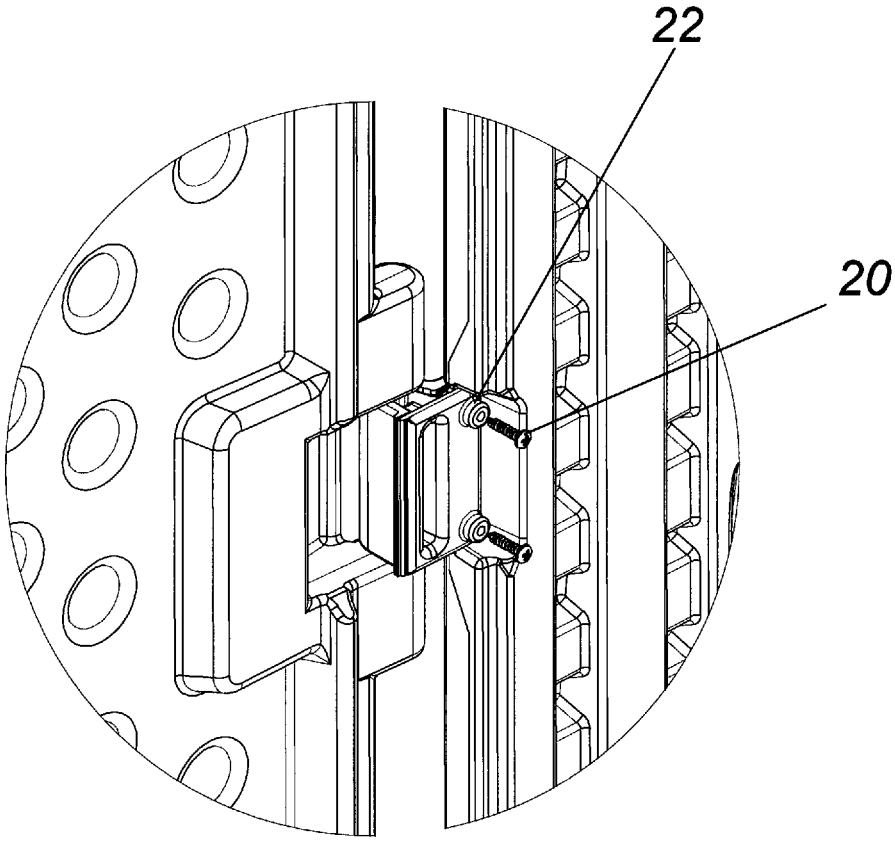
FIG. 4 is a partial perspective view, illustrating the assembly of the foldable hinge assembly.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE PREFERRED EMBODIMENTS

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to FIGS. 1-4, a shed structure 10 utilizing the folding hinge assembly 100 is illustrated. The folding hinge assembly 100 is generally constructed and arranged to be folded around a mounted hinge pin 12 to create a hinge pin barrel 16. The wing portions 18, 19 of the hinge can then be secured to a portion of the structure 10 to allow a door 14 or similar structure to pivot as desired. In a most preferred embodiment, the wings are secured to the structure with fasteners 20.

Figure 5:
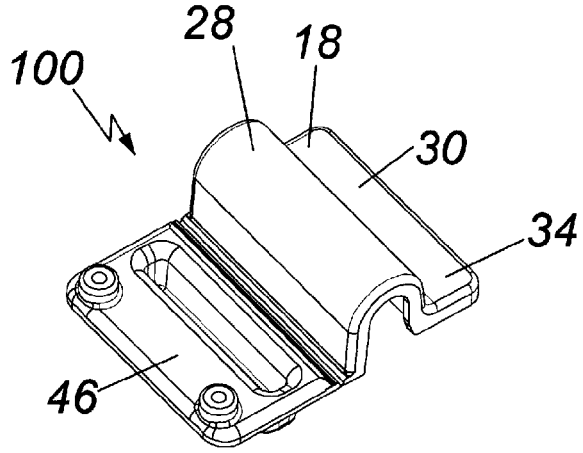
FIG. 5 is a front perspective view of one embodiment of the foldable hinge assembly in an unfolded condition.
Figure 6:
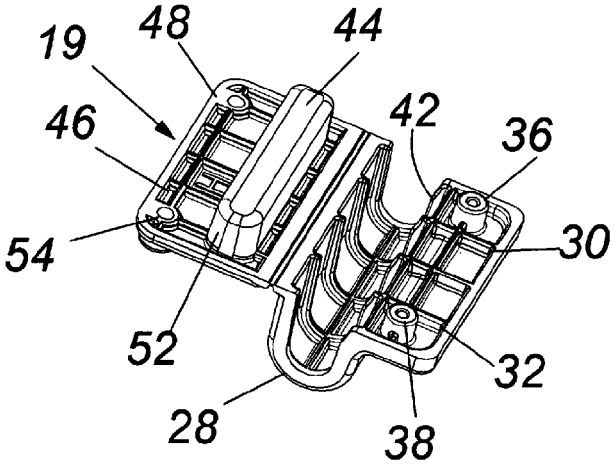
FIG. 6 is a rear perspective view of one embodiment of the foldable hinge assembly in an unfolded condition.
Figure 7:
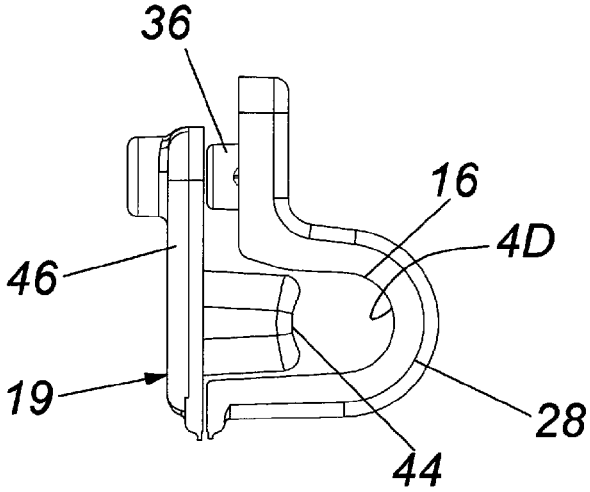
FIG. 7 is a top view of one embodiment of the folded hinge assembly in a folded condition.

Referring to FIGS. 5-7, a preferred embodiment of the folding hinge assembly 100 is illustrated. The folding hinge assembly body includes a first wing member 18 and a second wing member 19, each said wing member including a portion of a hinge barrel 16. The first wing 18 member is hingedly connected to the second wing member 19 for movement between an open position (FIG. 5) and a closed position (FIG. 7), whereby said first and said second wing members form a hinge barrel 16 in the closed position. In a most preferred embodiment, the hinge is a living hinge formed through an injection or blow molding process. However, it should be noted that other types of hinges could be utilized without departing from the scope of the invention.

The hinge barrel 16 is sized and shaped to cooperate with a hinge pin 12 (FIG. 3) for axial rotation between the foldable hinge assembly and the hinge pin while maintaining axial alignment therebetween. The first wing member 18 includes a U-shaped portion 28 and a first outwardly extending flange 30. The first flange 30 includes an inner surface 32 and an outer surface 34; the inner surface 32 preferably includes at least one and more preferably two alignment boss(es) 36. The alignment boss(es) are sized and shaped to cooperate with a similarly sized and shaped pocket in a panel adjacent to the opening to provide alignment and positioning of the first wing member. In some embodiment, the alignment boss(es) include an inner bore 38 sized to cooperate with a fastener 20.

The U-shaped portion 28 generally includes an inner surface 40 which cooperates with the hinge pin 12 to maintain axial alignment between the two statically and dynamically. In at least one embodiment, the inner surface of the U-shaped portion of the first wing member includes a plurality of inwardly extending ribs 42. An innermost surface of the ribs 42 is sized to cooperate with an outer surface of the hinge pin. The ribs may be arranged in any manner that is suitable to the wear and load characteristics of the assembly. For example, the ribs may extend transversely, in axial alignment with the hinge pin, radially about the internal surface of the U-shaped portion, or any suitable combination. The ribs provide several advantages: they reduce weight and material requirements, and add strength to the wing member, while reducing friction to the assembly.

Still referring to FIGS. 5-7, the second wing member 19 generally includes an elongated cylindrical surface 44 and a second outwardly extending flange 46. In a most preferred embodiment, the inner surface 48 includes an elongated boss 52 extending outwardly therefrom. The cylindrical surface 44 is positioned on an uppermost surface of the elongated boss. The elongated boss is sized to fit into the U-shaped portion of the first wing member 18 to close the barrel around the hinge pin.

The second wing member 19 includes a second outwardly extending flange 46; the second flange is generally constructed and arranged to align with the first flange 30 when the foldable hinge assembly 100 is in the closed position (FIG. 7). The second flange 46 includes at least one fastener aperture 54 extending through the second flange. The fastener aperture(s) 54 in the second flange of the second wing member are positioned to align with the aperture(s) 38 in the alignment boss(es) 36 when the foldable hinge is in said folded position.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A foldable hinge assembly comprising:

a hinge body including a first wing member and a second wing member, said first wing member includes a U-shaped portion, said first wing member hingedly connected to said second wing member via a living hinge for movement between an open position and a closed position, said living hinge formed as a thinned section extending across the width of said hinge body, said second wing member includes an elongated boss extending outwardly from an inner surface of said second wing member, said elongated boss sized to fit into said U-shaped portion, whereby said U-shaped portion and said elongated boss form a hinge barrel in said closed position, said hinge barrel sized to cooperate with an outer surface of a hinge pin for axial alignment and rotation between said foldable hinge and said hinge pin, said hinge pin secured to a surface adjacent said foldable hinge assembly.

2. The foldable hinge assembly of claim 1 wherein said inner surface of said U-shaped portion of said first wing member includes a plurality of inwardly extending ribs, an innermost surface of said plurality of ribs sized to cooperate with an outer surface of said hinge pin.

3. The foldable hinge assembly of claim 2 wherein said plurality of ribs extend transversely and in a spaced apart relationship with respect to the longitudinal axis of said hinge pin.

4. The foldable hinge assembly of claim 2 wherein said plurality of ribs extend radially and substantially axially aligned with respect to the longitudinal axis of said hinge pin.

5. The foldable hinge assembly of claim 2 wherein a portion of said plurality of ribs extend radially and substantially axially aligned with respect to the longitudinal axis of said hinge pin and a portion of said plurality of ribs extend transversely and in a spaced apart relationship with respect to the longitudinal axis of said hinge pin.

6. The foldable hinge assembly of claim 1 wherein said U-shaped portion includes a first outwardly extending flange said first flange includes an inner surface and an outer surface, said inner surface including at least one alignment boss, said at least one alignment boss is sized and shaped to cooperate with a similarly sized and shaped pocket positioned on said second wing member to provide alignment and positioning of said first wing member with respect to said second wing member.

7. The foldable hinge assembly of claim 6 wherein said at least one alignment boss includes an inner bore, said inner bore sized to cooperate with a fastener.

8. The foldable hinge assembly of claim 1 wherein said second wing member includes a cylindrical surface, said cylindrical surface sized to fit at least partially within said U-shaped portion.

9. The foldable hinge assembly of claim 8 wherein said second wing member includes a second outwardly extending flange, said second flange constructed and arranged to align with said first flange when said foldable hinge is in said closed position.

10. The foldable hinge assembly of claim 8 wherein said second wing member includes an elongated boss extending outwardly from an inner surface of said second wing member, said cylindrical surface positioned on an uppermost surface of said elongated boss, said elongated boss sized to fit into said U-shaped portion.

11. The foldable hinge assembly of claim 9 wherein said second flange includes at least one fastener aperture extending through said second flange.

12. The foldable hinge assembly of claim 11 wherein said fastener apertures in said second flange of said second wing member are positioned to align with said at least one aperture in at least one alignment boss when said foldable hinge is in said folded position.

* * * * *